US007711274B2

(12) United States Patent
Zaima

(10) Patent No.: US 7,711,274 B2
(45) Date of Patent: May 4, 2010

(54) IMAGE FORMING APPARATUS, IMAGE FORMING SYSTEM, AND METHOD OF CONTROLLING IMAGE FORMING APPARATUS

(75) Inventor: Nobuhiko Zaima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 395 days.

(21) Appl. No.: 11/390,833

(22) Filed: Mar. 28, 2006

(65) Prior Publication Data

US 2006/0228123 A1 Oct. 12, 2006

(30) Foreign Application Priority Data

Apr. 6, 2005 (JP) ..... 2005-109892

(51) Int. Cl.
*G03G 15/00* (2006.01)

(52) U.S. Cl. ..... 399/24

(58) Field of Classification Search ..... 399/8, 399/24, 27

See application file for complete search history.

(56) References Cited

U.S. PATENT DOCUMENTS

2002/0172520 A1* 11/2002 Suyehira ..... 399/24
2004/0213592 A1* 10/2004 Rodriguez ..... 399/24
2005/0053387 A1* 3/2005 Itoh ..... 399/27

FOREIGN PATENT DOCUMENTS

JP 6-14167 A 1/1994
JP 2001-228760 A 8/2001

* cited by examiner

*Primary Examiner*—David M Gray
*Assistant Examiner*—Joseph S Wong
(74) *Attorney, Agent, or Firm*—Canon U.S.A., Inc. I.P. Division

(57) ABSTRACT

An image forming apparatus is provided which is capable of preventing a drop in productivity even if a consumable such as toner is not replenished as expected. The image forming apparatus has a feature of shifting to a mode of saving the consumable if an arrival time of the consumable is determined to be later than a time when the consumable needs to be replenished, on the basis of the shipping status information on the consumable obtained from a management server and the calculated time when the consumable needs to be replenished.

11 Claims, 8 Drawing Sheets

IMAGE FORMING APPARATUS, IMAGE FORMING SYSTEM, AND METHOD OF CONTROLLING IMAGE FORMING APPARATUS

BACKGROUNG OF THE INVENTION

1. Field of the Invention

The present invention relates to an image forming apparatus, an image forming system, and a method of controlling the image forming apparatus using an electrophotographic technology, which is used in a copying machine, a printer, and so forth.

2. Description of the Related Art

Conventionally, a user or service personnel has placed an order for consumables such as toner for an image forming apparatus using electro-photographic technology on the basis of experience. Sometimes this results in a low prediction accuracy, and thus, in many cases, either excess stock or out-of-stock situations.

Accordingly, Japanese Patent Laid-Open No. 2001-228760 suggests an automatic management system wherein an image forming apparatus itself automatically detects a consumable consumption and places an order for the consumable so as to achieve an appropriate supply thereof.

Even if using this type of automatic management system, however, there are some cases where the consumable is not supplied in time since it makes no difference in order placement based on prediction. For example, there are cases where large-quantity output is accidentally made after an order placement of a consumable and where the expected consumable does not arrive on schedule due to a trouble during consumable shipment.

Unless the expected consumable arrives on schedule as described above, a copying operation is suspended, thereby causing a problem of a drop in productivity. Moreover, in preparation for a failure of prediction, there is a need to secure some stock of the consumable item.

SUMMARY OF THE INVENTION

In order to solve the aforementioned problems, an aspect of the present invention is to provide an image forming apparatus, an image forming system, and a method of controlling the image forming apparatus capable of preventing a drop in productivity even if a consumable is not replenished as expected.

To achieve the above, according to an exemplary embodiment of the present invention, there is provided an image forming apparatus capable of communicating with a management server for managing shipping status information on a consumable. The apparatus includes a receiving device configured to receive the shipping status information on the consumable from the management server; a calculating device configured to calculate a time when the consumable needs to be replenished; and a saving mode shifting device configured to cause a shift to a mode of saving the consumable if an arrival time of the consumable is determined to be later than the time when the consumable needs to be replenished on the basis of the shipping status information on the consumable received by the receiving device and the time when the consumable needs to be replenished calculated by the calculating device.

According to another embodiment of the present invention, there is provided an image forming system including a management server for managing shipping status information on a consumable and an image forming apparatus connected to the management server via a network. The system includes a transmitting device configured to transmit the shipping status information on the consumable to the image forming apparatus, the transmitting device being provided in the management server; a receiving device configured to receive the shipping status information on the consumable transmitted by the transmitting device, the receiving device being provided in the image forming apparatus; a calculating device configured to calculate a time when the consumable needs to be replenished, the calculating device being provided in the image forming apparatus; and a saving mode shifting device configured to cause a shift to a mode of saving the consumable if an arrival time of the consumable is determined to be later than the time when the consumable needs to be replenished, on the basis of the shipping status information on the consumable received by the receiving device and the time when the consumable needs to be replenished calculated by the calculating device, the saving mode shifting device being provided in the image forming apparatus.

According still to another embodiment of the present invention, there is provided a method of controlling an image forming apparatus capable of communicating with a management server for managing shipping status information on a consumable. The methods includes receiving the shipping status information on the consumable from the management server; calculating a time when the consumable needs to be replenished; and causing a shift to a mode of saving the consumable if an arrival time of the consumable is determined to be later than the time when the consumable needs to be replenished on the basis of the shipping status information on the consumable received and the calculated time when the consumable needs to be replenished.

Further embodiments, aspects and features of the present invention will become apparent from the following description of exemplary embodiments with reference to the attached drawings.

DESCRIPTION OF THE EMBODIMENTS

First Exemplary Embodiment

An image forming apparatus and a management system according to a first embodiment of the present invention will be described in detail hereinafter in accordance with the accompanying drawings.

Figure 1:
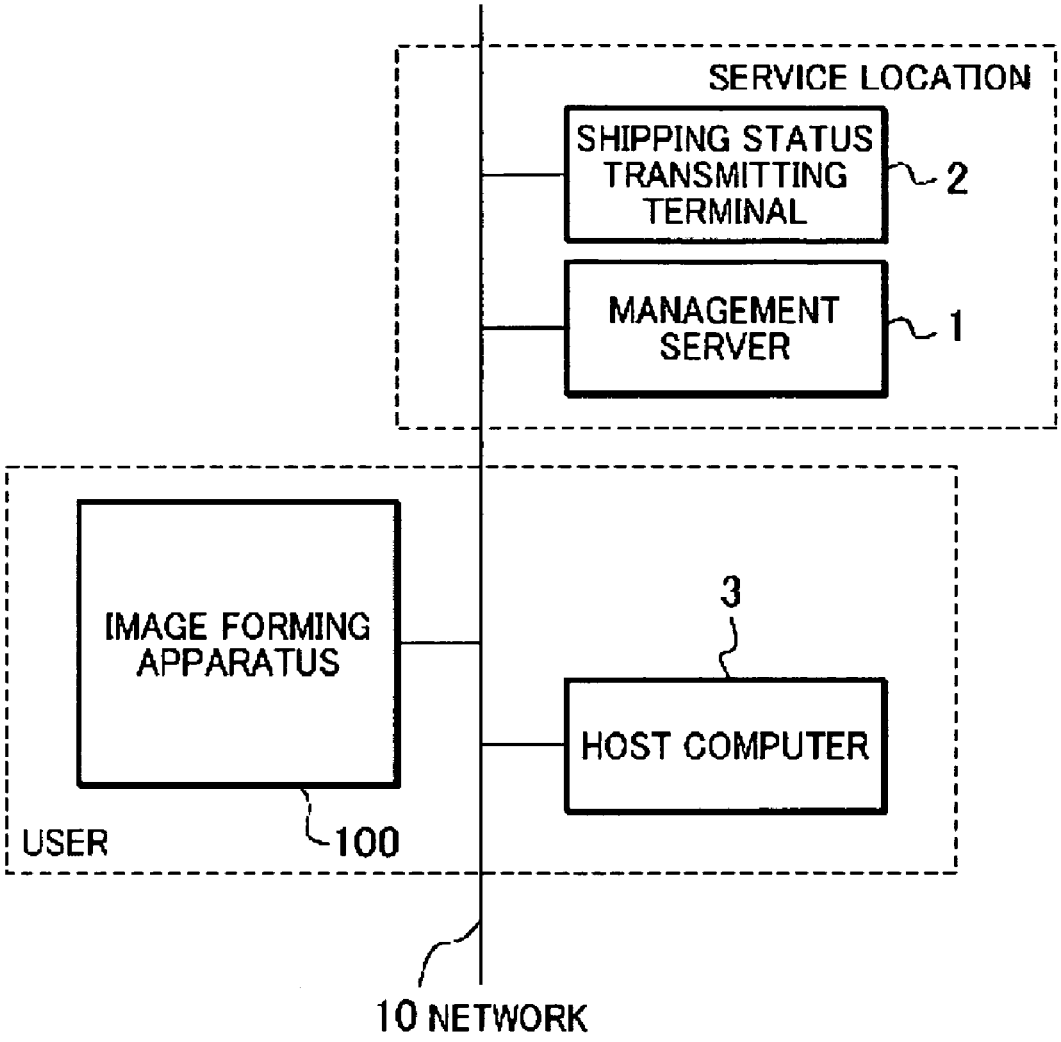
FIG. 1 is a diagram showing a general view of an exemplary image forming apparatus and a management system.

FIG. 1 shows a general view of an exemplary image forming apparatus and management system according to the first exemplary embodiment. The management server 1 is connected and in communication with a consumable shipping status transmitting terminal 2 and an image forming apparatus 100, which are capable of communicating with each other, via a network 10. Moreover, the image forming apparatus 100 is connected to a host computer 3 via the network 10 so as to output an image or the like upon output request of an application on the host computer 3.

In this embodiment, the management server 1 and the consumable shipping status transmitting terminal 2 are installed in a service location of a vendor. The consumable shipping status transmitting terminal 2 may also be installed in a base of a delivery company in charge of delivering the consumable or in a delivery truck. It is assumed here, for exemplary purposes, that the image forming apparatus 100 is a color electrophotographic printer and the consumable is toner. However, the present invention should not be limited to specific apparatus types or certain consumables.

For instance, in this embodiment, the toner is contained in an attachable/detachable toner cartridge and the toner cartridge is replaced as a consumable. It should be noted here that neither the image forming apparatus nor the consumable needs to be limited to those of this embodiment. In this embodiment, the image forming apparatus 100 and the host computer 3 are located in a user's place.

The management server 1 is configured to place an order for a toner cartridge upon receiving an order request from the image forming apparatus 100 and then store a fact that the order has been placed for the toner cartridge for the image forming apparatus 100 together with the date and time and the quantity. Moreover, the management server 1 is configured to accept a shipping status of the toner cartridge from the consumable shipping status transmitting terminal 2 at any time and stores it together with the order date and time.

In the service location, information on the delivery system is managed and toner cartridge shipping information is sent to the management server 1 as needed by the consumable shipping status transmitting terminal 2. The toner cartridge shipping information can include a scheduled arrival date and time of the toner cartridge and the current position thereof created based on information from a delivery center, a delivery truck, and so forth.

The image forming apparatus 100 can detect toner consumption automatically, detect a time when the toner cartridge needs to be replaced, and transmit a toner cartridge order request to the management server so as to match the time. Moreover, it can receive toner cartridge delivery information on the management server. When determining that the arrival of the toner cartridge will not be in time by comparison with the time when the toner cartridge needs to be replaced, the image forming apparatus 100 can start a toner save mode to suppress the toner consumption.

Subsequently, the image forming apparatus 100 according to this embodiment of the present invention will be described in detail below.

Figure 2:
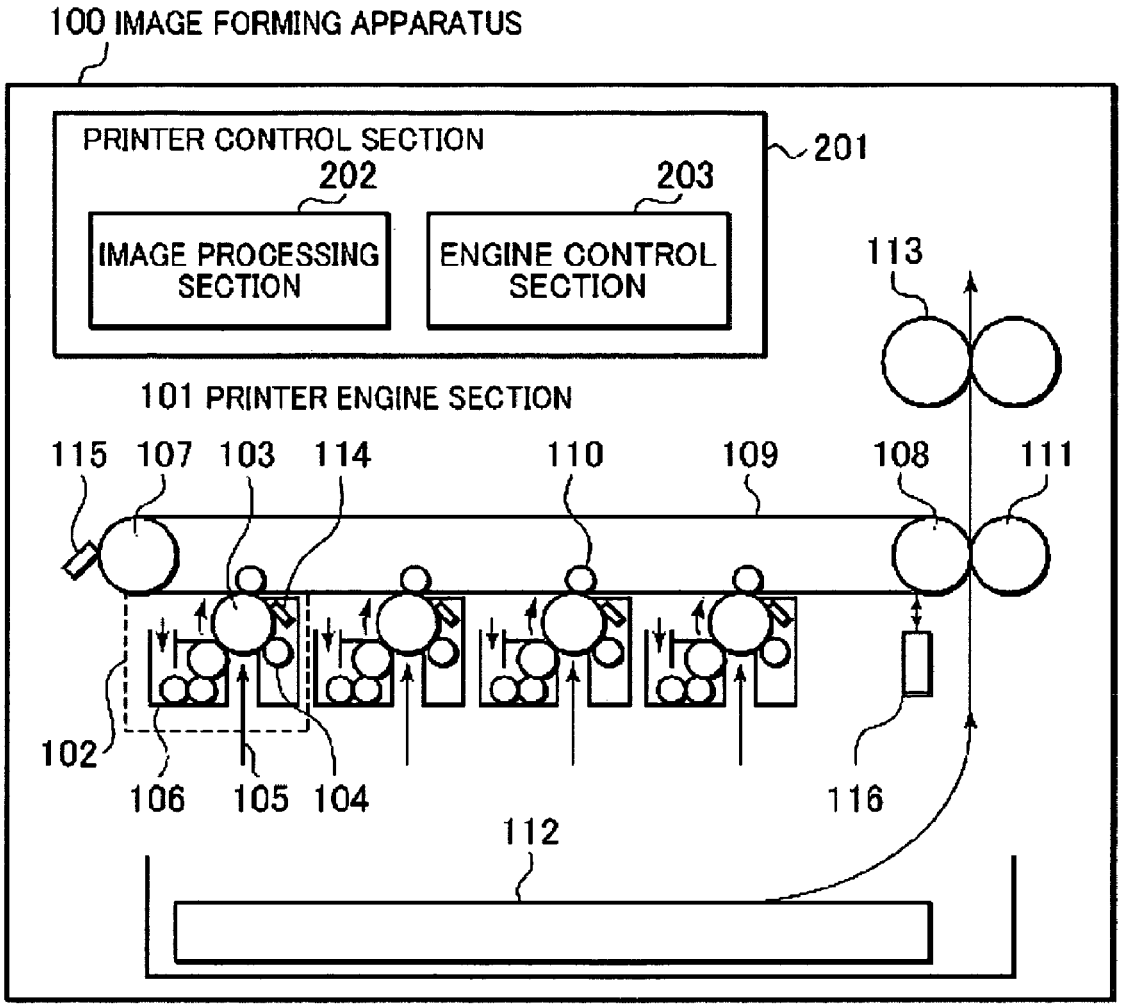
FIG. 2 is a diagram showing a general view of an exemplary image forming apparatus.

FIG. 2 shows a general view of an exemplary image forming apparatus 100. In a printer engine section 101, reference numeral 102 denotes a process cartridge with a photosensitive drum, a developing device, a primary charger, and a photosensitive drum cleaner integrated therein. This embodiment is a 4-drum full-color printer employing a tandem system in which four process cartridges are arranged in series.

Reference numeral 103 denotes an electrophotographic sensitive drum having amorphous silicon, selenium, OPC, and so forth on its surface and rotating in the direction of arrow. The photosensitive drum 103 is equally charged with electricity by the primary charger 104, first, and then exposed to and scanned by a laser beam in an exposure section 105 on the basis of drawing data as described later, by which an electrostatic latent image is formed on the photosensitive drum 103. The latent image is reversely developed into a toner image on the photosensitive drum 103 by using a two-component developer including a mixture of nonmagnetic toner and carrier. The reversal development is a development method including the steps of forming a latent image as an exposed area of a photosensitive member on the surface of the photosensitive drum 103 and transferring toner charged in the same polarity as that of the latent image to the area so as to visualize the latent image.

The above toner image is transferred in a primary transfer section 110 onto an endless intermediate transfer belt 109, which is suspended between rollers 107 and 108 and endlessly driven in the direction of arrow, and then transferred in a secondary transfer section 111 onto transfer paper, which is fed from a cassette 112. The transfer paper to which the toner image has been transferred is conveyed to a fixing device 113, where the toner image is fixed to the transfer paper.

On the other hand, residual toner after the primary transfer on the photosensitive drum 103 is removed by a photosensitive drum cleaner 114, and residual toner after the secondary transfer on the intermediate transfer belt 109 is removed by a belt cleaner 115. Toner is replenished into the developing device from a toner cartridge, which is not shown, via a toner hopper by a conveying screw. Reference numeral 116 denotes a density sensor including a light source such as an LED for detecting the amount of toner (density) of an image pattern on the intermediate transfer belt 109 and a photoelectric conversion element.

The process cartridge and the toner cartridge are attachable or detachable to or from the image forming apparatus 100 and replaced at each economic life. The host computer 3 generates image data including color information, character information, graphic information, a raster image, control information, and so forth (including, PDL data) and transmits them to a printer control section 201.

The printer control section 201 includes an image processing section 202 for receiving the image data from the host computer 3 and converting (developing) the image data to drawing data (raster image data) and an engine control section 203 for activating a printer engine to form an output image on the basis of the drawing data supplied from the image processing section 202.

The image processing section 202 receives the image data from the host computer 3 and sequentially converts printed information such as color information, character information, graphic information, raster image, and so forth included in the image data to intermediate information (hereinafter, also referred to as object). If the printed information is tone data such as a gray level setting, a color level setting, a multi-level raster image, or the like at this point, the density level is corrected according to a density correction table (γLUT) created by a density correction characteristics control. Furthermore, raster image data is created on the basis of the object. At this point, a pseudo halftone process is conducted to an image to be drawn.

The raster image data is sent as drawing data to the engine control section 203. The engine control section drives a laser beam of the exposure section on the basis of the drawing data and forms an electrostatic latent image onto the photosensitive drum.

The timing of the density level correction according to the density correction table is not limited to when the object is created, but can be after the image data in units of objects is converted to raster image data.

Subsequently, a method of calculating the toner cartridge order placement time will be described below.

First, toner consumption needs to be detected in order to calculate the order placement time. The toner consumption is detected using a video count control for use in a toner replenishment control.

The video count control is conducted by adding image information signals from the host computer 3, estimating toner consumption, and sequentially replenishing toner according to the estimated consumption.

For controlling the amount of toner to be replenished to the developing device 106 in a video count method, the levels of the drawing data of the image processing section 202 are counted for each pixel. The integrated signal for one image of the counts corresponds to the amount of toner consumed in the developing device 106 (see FIG. 2) to form the one image.

The above integrated signal is stored in the engine control section 203. The engine control section 203 calculates a rotational drive time of the conveying screw required to supply toner from the toner hopper to the developing device 106 by the corresponding amount of toner consumed in the developing device 106 described above and controls a motor drive circuit to drive the motor for the above period of time. Therefore, generally the motor drive time is longer if the above integrated value is larger, and the motor drive time is shorter if the integrated value is smaller.

The motor driving force is transmitted to the conveying screw via a gear train and the conveying screw conveys the toner in the toner hopper to supply it to the developing device 106. The toner replenishment is conducted whenever the development of one image is completed.

The image processing section 202 passes the integrated signal for one image to the engine control section 203 and also sends the integrated signal for one image to the printer control section 201. The printer control section 201 adds up the counts for all images after the last toner cartridge replacement and stores the result and further calculates and stores an average of the integrated signals for one image sent from the image processing section 202. Based on the integrated signal for all images and the average of the integrated signals for one image, predictions are made about the toner consumption for order placement of the toner cartridge and the toner cartridge replacement time.

The printer control section 201 converts the integrated signal for all images and the average integrated signal for one image to toner consumptions and calculates the remaining number of prints outputtable if the toner is used averagely from this time on from the capacity of the toner cartridge. Moreover, it calculates the toner cartridge replacement time from the average number of prints during a predetermined time separately stored.

Additionally, the image forming apparatus 100 presets the average time from order placement to arrival of the toner cartridge in its installation environment when installed. The image forming apparatus 100 can calculate the toner cartridge order placement time from the information.

The following describes the consumable management after order placement of the toner cartridge, which is a feature of the present invention. In this embodiment, the toner cartridge replacement time is detected at predetermined time intervals and the detection of the toner cartridge replacement time is continued even after the toner cartridge order placement.

In the duration after the toner cartridge order placement until the toner cartridge replacement, the image forming apparatus 100 compares the calculated toner cartridge replacement time with the toner cartridge arrival time received from the management server 1, and if it is determined that the toner cartridge arrival time is later than the toner cartridge replacement time, it starts the toner save mode to suppress the toner consumption so as to put off the toner cartridge replacement time.

In this embodiment, the density correction characteristics (γLUT) have been used for the toner save mode. The toner save mode using the density correction characteristics (γLUT) will be described hereinafter.

The image forming apparatus 100 conducts the density correction characteristics control (γLUT control) to stabilize the density of the output image. The printer control section 203 forms a patch image (image pattern) for the density correction characteristics control on the intermediate transfer belt 109 and measures the density using the density sensor 116. Then, the printer control section 203 compares a result of the measurement using the density sensor 116 with a standard density in the density level of the drawing data corresponding to the patch image related to the measurement and creates a density correction table (γLUT) defining density conversion rules where the density level of the image data before density correction has a linear relationship with the density of the output image.

Figure 3:
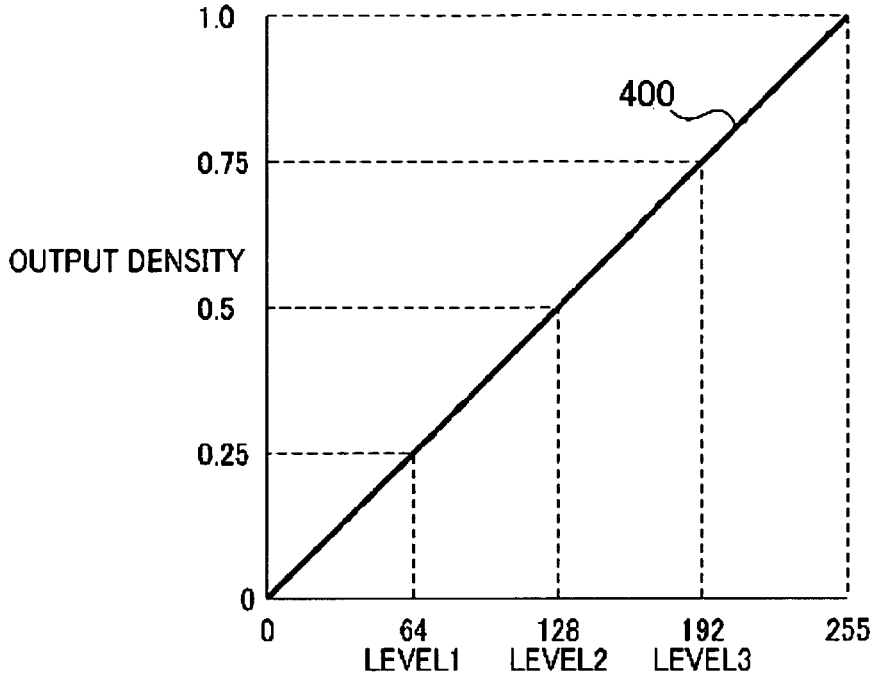
FIG. 3 is a diagram showing an output density characteristic in an ideal state.

FIG. 3 shows a relationship between the density level of the image data and the output density (output density characteristic) in an ideal state. As shown in FIG. 3, a characteristic curve 400 is a straight line in the ideal state and the output density characteristic has linearity. Although the printer maintains this characteristic in an ordinary condition, the characteristic varies due to temperature or humidity fluctuations and temperature fluctuations or deterioration of the photosensitive drum and developer in the printer engine or those of the fixing device, namely, changes in output conditions.

Figure 4:
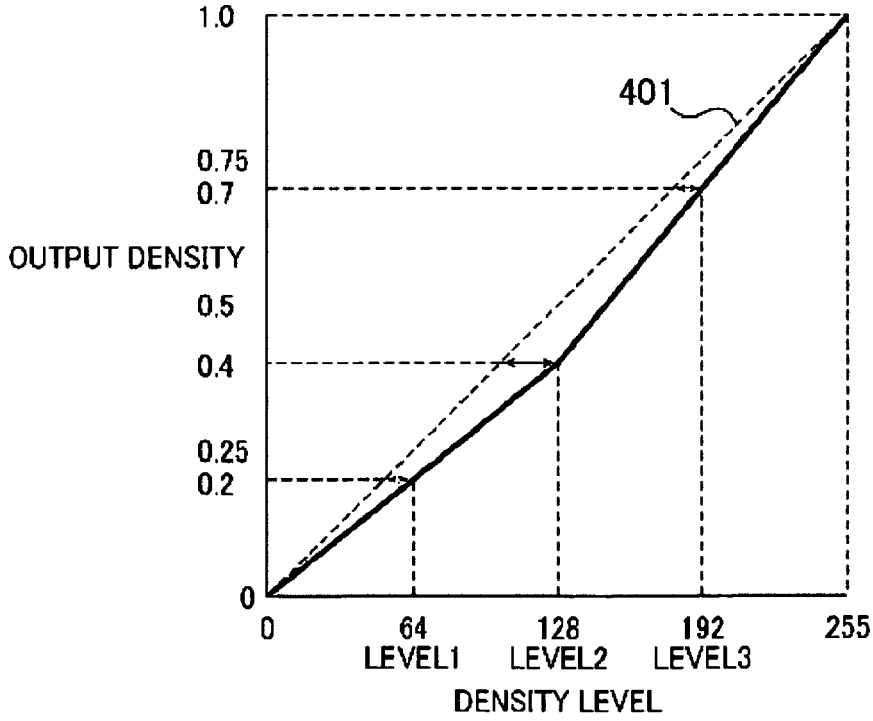
FIG. 4 is a diagram showing an output density characteristic observed when output conditions have changed.

FIG. 4 shows an example of changes in the output density characteristic caused by changes in output conditions. A characteristic curve 401 represents an output density characteristic when the normalized output density is 0.2 at level 1, 0.4 at level 2, and 0.7 at level 3. In the above density correction table creation, the density correction table is created for correcting the density level of the image data so as to achieve the characteristic curve 401 coincident with the ideal characteristic curve 400.

In this manner, a patch image for the density correction characteristics control is formed and its output density is measured by the density sensor 116, and then the density correction table (γLUT) is updated, whereby the ideal density characteristic can be maintained independently of changes in output conditions.

The toner save mode is achieved by changing the ideal density characteristic. More specifically, the density correction table created in such a way as to achieve the ideal density characteristic by the density correction characteristics control is changed to a density correction table in such a way as to have a density characteristic of suppressing toner consumption.

Figure 5:
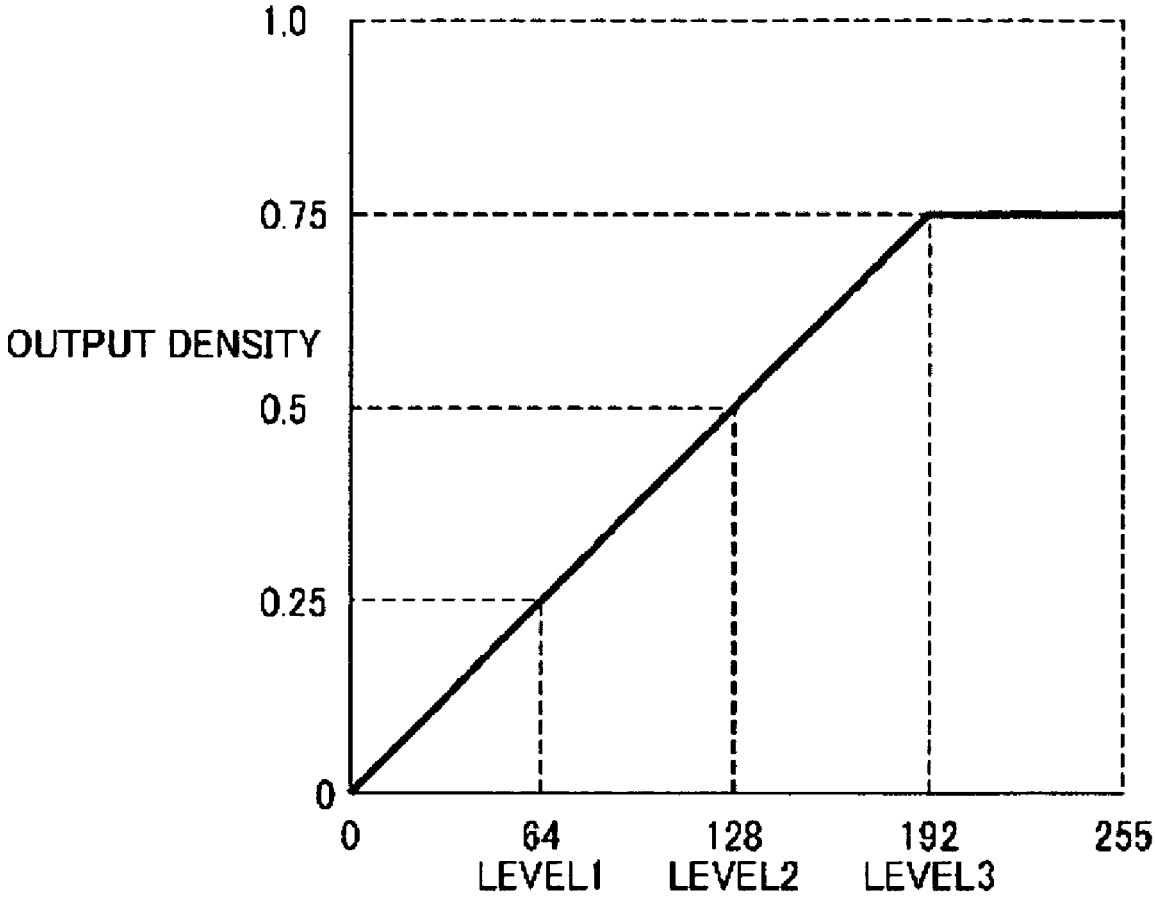
FIG. 5 is a diagram showing an output density characteristic for a toner save mode in a first embodiment.

FIG. 5 shows a density characteristic of suppressing toner consumption according to this embodiment. By using the density characteristic, toner consumption can be suppressed since the high-density image output is controlled. Due to the suppressed toner consumption, the toner cartridge replacement time can be put off, whereby the arrival of the toner cartridge can be awaited with no drop in productivity. Moreover, although an image quality is deteriorated due to a decrease in the maximum density and a decrease in gradation of the high-density area, the density characteristic for saving toner has been created so that the deterioration is kept within an allowable range in this embodiment by utilizing the visual property that the human visual sensitivity is low in the high-density area.

During toner save mode startup, the integrated value of the toner consumption signal is corrected by the change of the density characteristic, so that the actual consumption is coincident with the signal value. If the consumption speed drops due to the toner save mode startup and thereby the arrival of the toner cartridge becomes earlier than the toner cartridge replacement time again, the toner save mode is reset. Moreover, during toner save mode startup, a display indicating that the toner save mode is under startup appears on the display section 204, which is not shown, mounted on the image forming apparatus 100.

Figure 6:
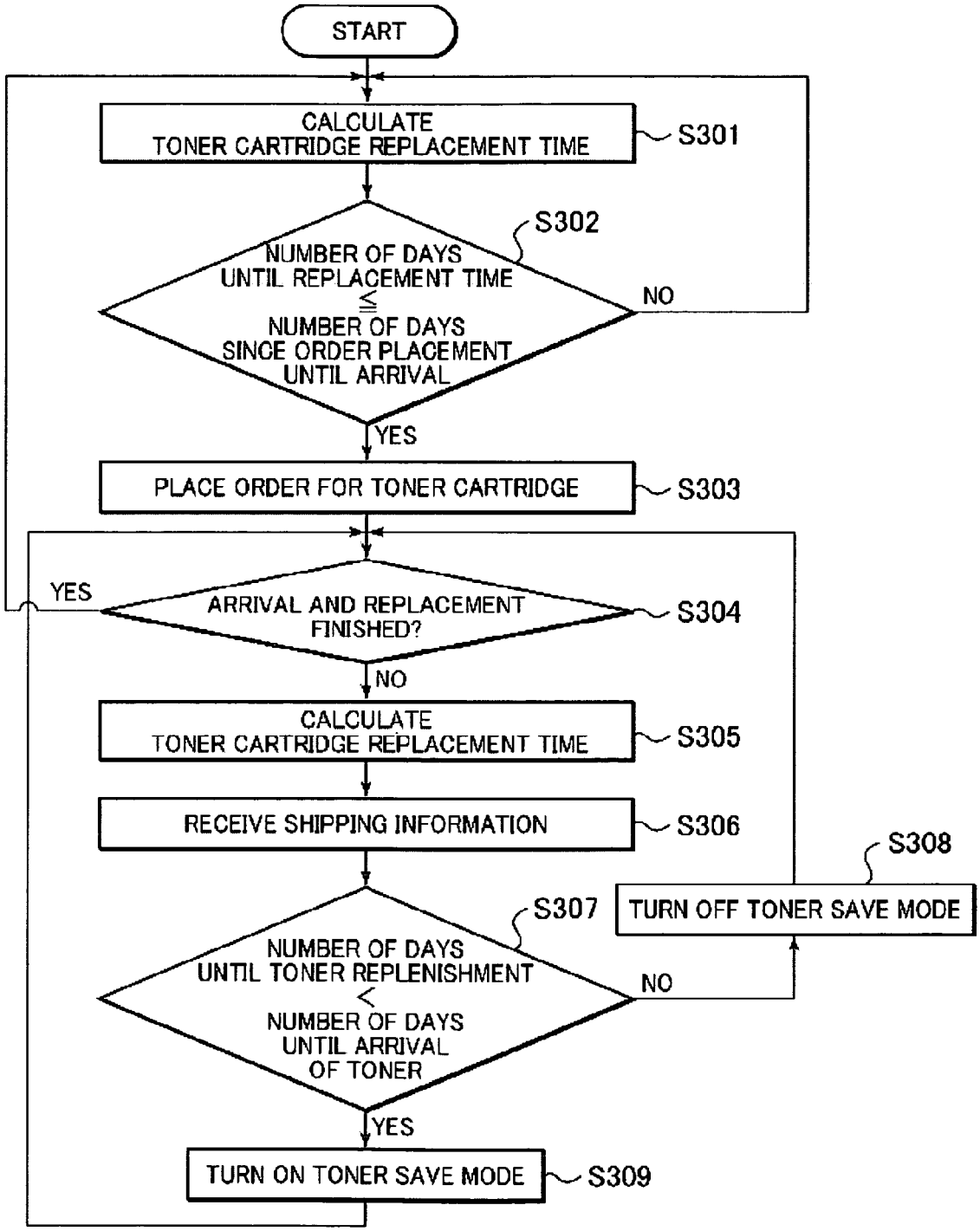
FIG. 6 is a flowchart of exemplary processing performed by the image forming apparatus.

An exemplary toner management flow diagram characterizing this embodiment will be described below by using FIG. 6. The toner management flow in FIG. 6 is executed in the printer control section 201.

First, the image forming apparatus 100 calculates the toner cartridge replacement time by detecting the amount of toner remaining (S301) and compares the number of days until the toner cartridge replacement time with the number of days since the order placement of a toner cartridge until the arrival thereof (S302). If the number of days until the toner cartridge replacement time is equal to or less than the number of days since the order placement of the toner cartridge to the arrival thereof, an order is placed for the toner cartridge via the management server 1 (S303).

After the order placement of the toner cartridge, it is determined whether the toner cartridge has arrived and the replacement has already been done (S304). If the toner cartridge has arrived and the replacement has been done, the control returns to step S301. Unless the toner cartridge has been replaced yet, the printer control section 201 recalculates the toner cartridge replacement time at a predetermined timing (S305), receives the toner cartridge shipping information from the management server 1, which stores information sent from the consumable shipping status transmitting terminal 2 (S306), and compares the number of days until the toner cartridge replacement with the number of days until the arrival of the toner cartridge (S307).

If the number of days until the toner cartridge replacement is equal to or greater than the number of days until the arrival of the toner cartridge, the toner save mode is turned off (S308) and the arrival of the toner cartridge is awaited. If the number of days until the toner cartridge replacement is less than the number of days until the arrival of the toner cartridge, the toner save mode is turned on (S309) and the arrival of the toner cartridge is awaited.

Until the arrival and replacement of the toner cartridge, it is determined whether the toner save mode should be turned on or off at predetermined time intervals and is set appropriately. If the toner cartridge is replaced (S304), the toner save mode is turned off and then the control returns to the ordinary process of determining whether an order should be placed for a toner cartridge.

As described above, according to this embodiment, it is possible to provide a system capable of automatically placing an order for a consumable without a need for carrying stocks of consumables and to provide an image forming apparatus capable of preventing a drop in productivity even if a consumable is supplied later than expected.

Second Exemplary Embodiment

A second exemplary embodiment is characterized in that the issue of whether to shift to toner save mode can be set if the arrival of toner is determined to be later than schedule, even though the toner save mode is always started when the arrival of toner is determined to be later than schedule in the first embodiment. The following describes different features and aspects from the first embodiment.

In this embodiment, if the arrival of toner is determined to be later than schedule, the image forming apparatus 100 displays the toner save mode shift setting screen shown in FIG. 7 on the display section 204 in an operating section 205, which is not shown, mounted on the image forming apparatus 100, so as to enable setting of whether to shift to toner save mode.

To set the approval of the shift to toner save mode, select a key 207 corresponding to "YES" and then select an OK key 210. To set the disapproval of the shift to toner save mode, select a key 208 corresponding to "NO" and then select the OK key 210. If a cancel key 209 is selected, the setting of whether to shift to toner save mode is canceled.

If the approval of the shift to toner save mode is set, the process is similar to that of the first embodiment. Even if the disapproval of the shift to toner save mode is set, the toner information management operates, and if the arrival of toner is determined to be later than schedule, the shift to toner save mode is not made, but the information indicating this is displayed on the display section 204. If the setting is changed over here to the approval of the shift to toner save mode, the shift to toner save mode is immediately made.

Figure 7:
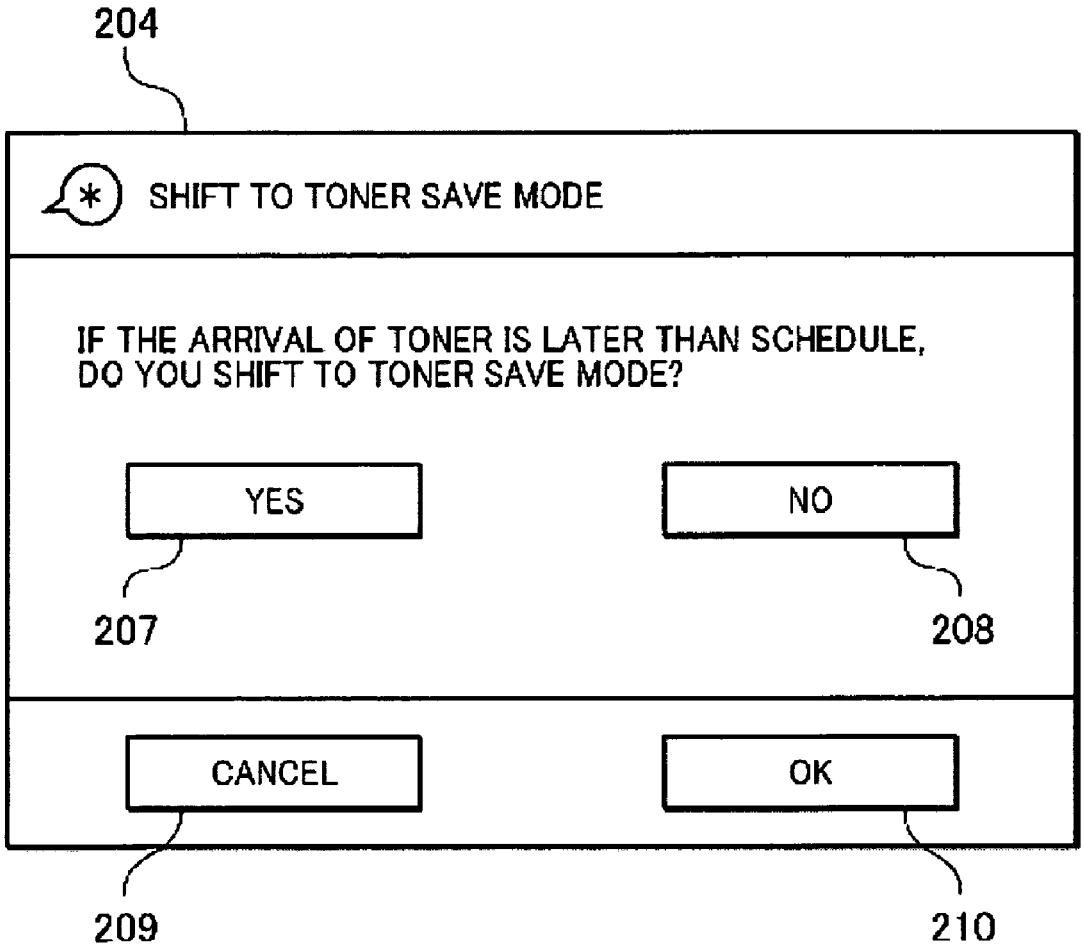
FIG. 7 is diagram showing an exemplary toner save mode shift setting screen according to a second exemplary embodiment.

While the toner save mode shift setting screen shown in FIG. 7 is displayed on the display section 204 if the arrival of toner is determined to be later than schedule in this embodiment, the toner save mode shift setting screen shown in FIG. 7 may also be displayed on the display section 204 in response to the depression of a user mode key in the operating section 205, which is not shown, by a user or a service personnel.

According to this embodiment, the user can select whether to give priority to productivity over image quality or vice versa if the arrival of toner is later than schedule, whereby the user can use this function in accordance with the status of use.

Third Exemplary Embodiment

A third exemplary embodiment is characterized in that there are provided a plurality of toner save modes different in toner saving level as the toner save mode described in the first embodiment, whereby the toner save modes can be used properly according to the conditions. The following describes different features and aspects from the first embodiment.

Figure 8A:
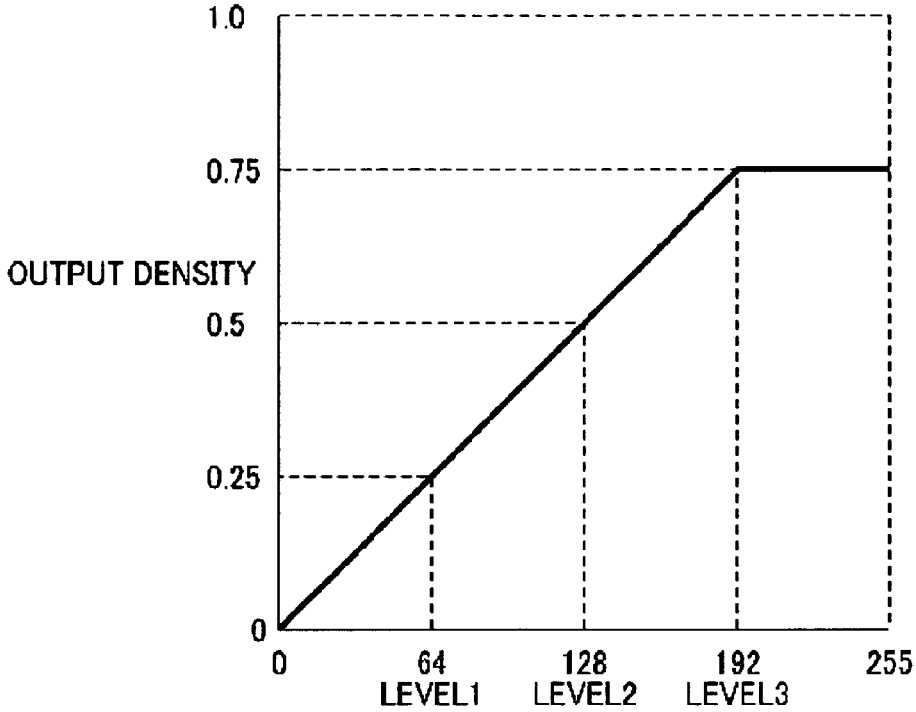
FIGS. 8A-B are diagrams showing output density characteristics for a toner save mode according to a third exemplary embodiment.
Figure 8B:
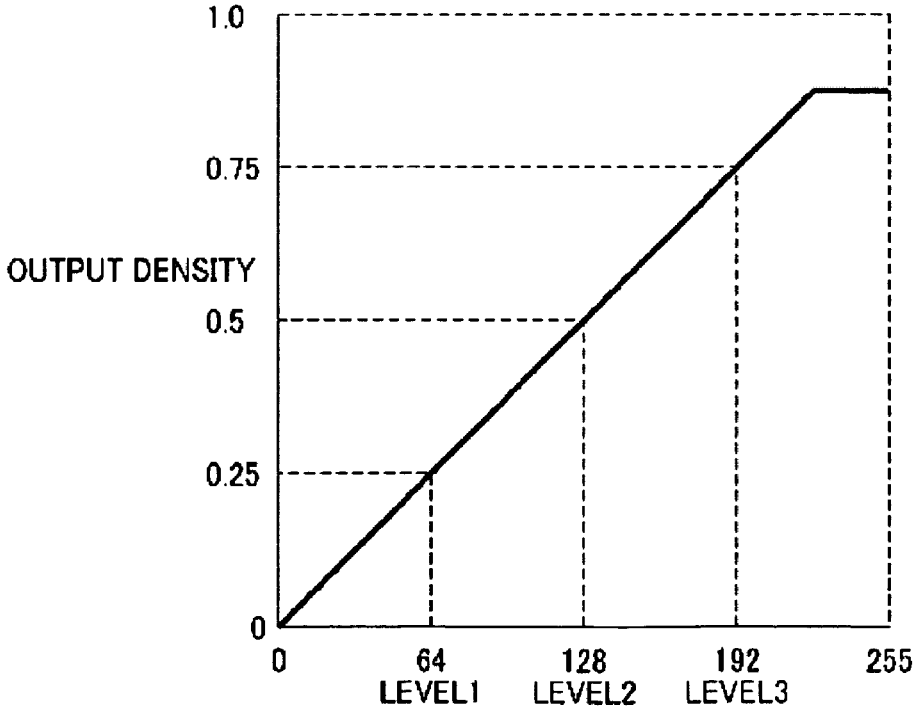

It is assumed that two types of density characteristics for saving toner are provided as shown in FIGS. 8A-B and two toner save modes are provided. FIG. 8A shows the same density characteristic as in the first embodiment. The toner save mode for achieving the density characteristic is referred to as toner save mode A. FIG. 8B shows a density characteristic where the saving level is lower than in FIG. 8A to give priority to the image quality. The toner save mode for achieving the density characteristic is referred to as toner save mode B.

In this embodiment, if it is determined that the toner save mode should be turned on when the toner save mode is off, the toner save mode B is started. If it is determined that the toner save mode should be turned on during startup of the toner save mode B, the toner save mode A is started. If it is determined that the toner save mode should be turned on during startup of the toner save mode A, the startup of the toner save mode A is continued.

If the toner save mode is started for the first time, in most cases there is not so much different between the toner cartridge replacement time and the toner cartridge arrival time. Therefore, the toner save mode of a low saving level is started first, and if recovery is not still observed, then the shift to toner save mode A is made to save toner largely, thereby maintaining constant productivity without causing unnecessary deterioration in image quality.

Figure 9:
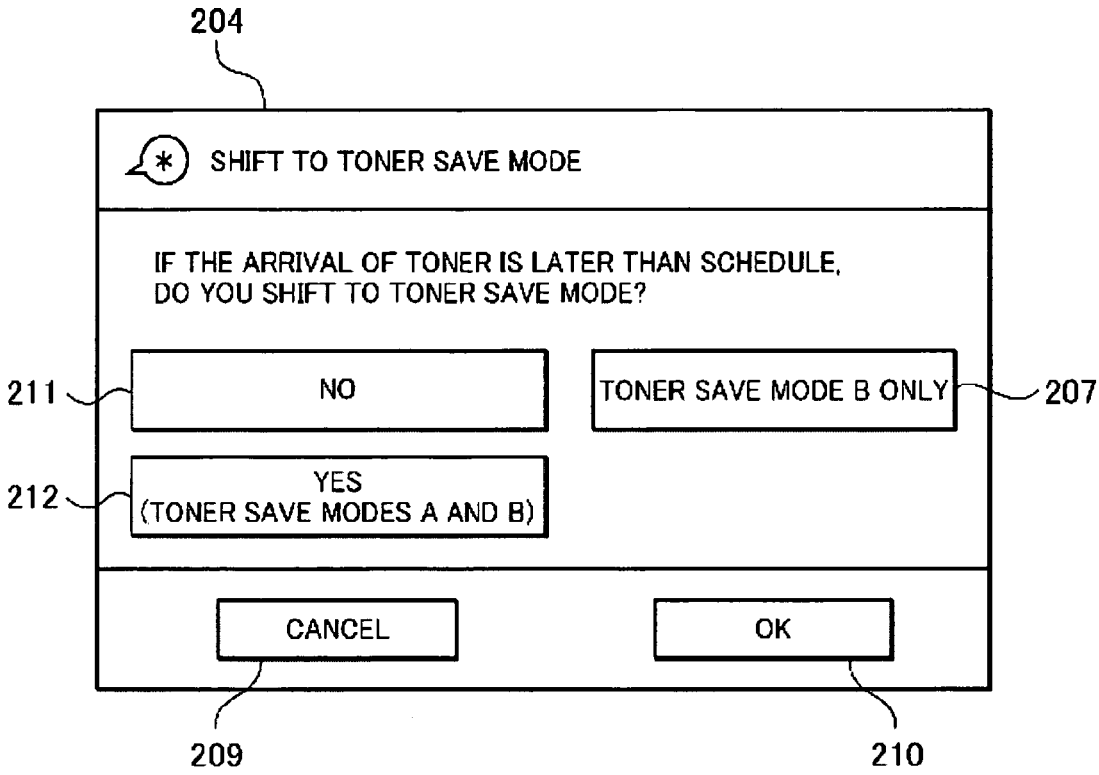
FIG. 9 is a diagram showing an exemplary toner save mode shift setting screen according to the third embodiment.

In this embodiment, whether to shift to toner save mode can be set as described in the second embodiment. In that case, as shown in FIG. 9, the following three levels of settings are also possible: (1) the disapproval of the shift to toner save mode; (2) the approval of the shift to toner save mode B only; and (3) the approval of the shift to toner save modes A and B, thereby allowing a user to set the toner save mode as usage. The setting can be achieved by selecting one of keys 207, 211, and 212 and then selecting the OK key 210.

In this instance, if it is determined that the toner save mode should be turned on during startup of the toner save mode B, the startup of the toner save mode B is naturally continued. This prevents a sudden change in image quality.

Other Exemplary Embodiments, Features and Aspects of the Present Invention

While toner has been used as a consumable to be managed in the above embodiments, the consumable to be managed need not be toner necessarily. On the contrary, it may be any consumable, as long as its consumption level is modifiable, such as, for example, oils, cleaning web, a waste toner box, and so forth.

For example, in the saving mode for a fixing oil, it is conceivable that the oil supply is decreased and then the amount of toner on paper is limited so as to achieve a normal output in that condition. Regarding the waste toner box, the amount of waste toner is decreased by decreasing toner consumption and therefore the time when the waste toner box is full can be put off. Moreover, the consumable may be paper. In this case, the use of another paper determined from image attributes and saving modes such as double-sided output or a reduction layout are conceivable.

Moreover, there is no need to limit the image forming apparatus to an electrophotographic printer, but may be an ink jet printer or a printing machine and the consumable may be an ink. Moreover, the toner save mode need not be limited to the above embodiments, but may be suppression of the used amount of toner in a color processing section, dot skipping, correction of the UCR amount, or the like, and it may be a change in image forming conditions such as a change in developing bias. Moreover, the consumable managed by a single management system need not be limited to a single type, but a plurality of types of consumables may be managed.

Incidentally, the present invention may be applied to a system including a plurality of image forming apparatuses. Moreover, it goes without saying that the object of the present invention is also achieved by supplying a system or apparatus with a storage medium storing a program code of software for implementing the functions of the above embodiments and by reading out and executing the program code stored in the storage medium by means of a computer (or CPU or MPU) of the system or the apparatus.

In this case, the program code itself read from the storage medium implements the functions of the above embodiments, and therefore the storage medium storing the program code constitutes the present invention.

As the storage medium for supplying the program code, for example, a flexible disk, a hard disk, a photo-magnetic disk, a CD-ROM, a CD-R, a magnetic tape, a non-volatile memory card, and a ROM can be used.

Further, it goes without saying that the present invention includes a concept that not only the functions of the above embodiments are implemented by executing the program code read out by means of the computer, but also the operating system (OS) running on the computer executes the actual processing partially or totally on the basis of instructions of the program code to implement the functions of the embodiments.

Still further, it goes without saying that the present invention includes a concept that, after the program code read from the storage medium is written into a memory of a function expansion board inserted into the computer or a function expansion unit connected to the computer, a CPU or the like of the function expansion board or of the function expansion unit executes the actual processing partially or totally on the basis of instructions of the program code to implement the functions of the above embodiments.

While the image forming apparatus has been described as a color electrophotographic printer, naturally it may be a black-and-white electrophotographic printer.

According to the above embodiments, if the arrival time of the consumable is determined to be later than the time when the consumable needs to be replenished, the mode is shifted to the mode for saving the consumable, whereby there is no drop in productivity even if the consumable is not replenished as expected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2005-109892, filed Apr. 6, 2005, which is hereby incorporated by reference herein in its entirety.

What is claimed is:

1. An image forming apparatus configured to communicate with a management server for managing shipping status information on a consumable, comprising:

a receiving device configured to receive an arrival time of the consumable from the management server;

a calculating device configured to calculate a time when the consumable is used up and needs to be replenished;

a saving mode shifting device configured to shift to a mode of saving the consumable; a determining device configured to determine at predetermined time intervals whether the consumable save mode should be turned on or off, until the arrival and replacement of the consumable; and a display device configured to display a saving mode shift setting screen for allowing a user to select whether to automatically shift to the mode of saving the consumable by the saving mode shifting device, if it is expected that the arrival time of the consumable received by the receiving device is later than the time when the consumable needs to be replenished calculated by the calculating device, wherein the saving mode shifting device automatically shifts to the mode of saving the consumable, if it is expected that the arrival time of the consumable received by the receiving device is later than the time when the consumable needs to be replenished calculated by the calculating device and the user selects to shift to the mode of saving the consumable from the saving mode shift setting screen displayed by the display device.

2. The image forming apparatus according to claim 1, wherein the saving mode includes a plurality of saving modes different in saving level.

3. The image forming apparatus according to claim 2, further comprising a setting device for setting one of the plurality of saving modes if the arrival time of the consumable is determined to be later than the time when the consumable needs to be replenished.

4. The image forming apparatus according to claim 2, wherein the plurality of saving modes includes a first saving mode having a higher saving level and a second saving mode having a lower saving level, and wherein the saving mode shifting device continues the first saving mode if a need for the shift to the save mode is determined during startup of the first saving mode.

5. The image forming apparatus according to claim 4, wherein the saving mode shifting device causes a shift to the second saving mode, first, when shifting to the saving mode, and then causes a shift to the first saving mode.

6. The image forming apparatus according to claim 4, wherein the saving mode shifting device continues the second saving mode if a need for the shift to the save mode is determined during startup of the second saving mode.

7. The image forming apparatus according to claim 1, further comprising an order placing device for placing an order for the consumable, wherein the calculating device calculates the time when the consumable needs to be replenished after the order placement of the consumable performed by the order placing device.

8. The image forming apparatus according to claim 1, the consumable comprising at least one of toner, fixing oil, cleaning web, a waste toner box, and paper.

9. The image forming apparatus according to claim 1, wherein the mode of saving the consumable is for use in saving toner to form an image on a sheet with less amount of toner than the normal mode.

10. The image forming apparatus according to claim 1, wherein the mode of saving the consumable is for use in modifying a density correction table so as to have a density characteristic of suppressing toner consumption.

11. An image forming system including a management server for managing shipping status information on a consumable and an image forming apparatus connected to the management server via a network, the system comprising:

a transmitting device configured to transmit an arrival time of the consumable to the image forming apparatus, the transmitting device being provided in the management server;

a receiving device configured to receive an arrival time of the consumable transmitted by the transmitting device, the receiving device being provided in the image forming apparatus;

a calculating device configured to calculate a time when the consumable is used up and needs to be replenished, the calculating device being provided in the image forming apparatus;

a saving mode shifting device configured to shift to a mode of saving the consumable, the saving mode shifting device being provided in the image forming apparatus; a determining device configured to determine at predetermined time intervals whether the consumable save mode should be turned on or off, until the arrival and replacement of the consumable; and a display device configured to display a saving mode shift setting screen for allowing a user to select whether to automatically shift to the mode of saving the consumable by the saving mode shifting device, the display device being provided in the image forming apparatus, if it is expected that the arrival time of the consumable received by the receiving device is later than the time when the consumable needs to be replenished calculated by the calculating device, wherein the saving mode shifting device automatically shifts to the mode of saving the consumable, if it is expected that the arrival time of the consumable received by the receiving device is later than the time when the consumable needs to be replenished calculated by the calculating device and the user selects to shift to the mode of saving the consumable from the saving mode shift setting screen displayed by the display device.

* * * * *